US006406560B1

(12) United States Patent
Lerche et al.

(10) Patent No.: US 6,406,560 B1
(45) Date of Patent: Jun. 18, 2002

(54) METHOD FOR THE THERMAL TREATMENT OF METAL

(75) Inventors: Wolfgang Lerche; Bernd Edenhofer; Michael Lohrmann, all of Kleve (DE)

(73) Assignee: Ipsen International GmbH (DE)

( * ) Notice: Subject to any disclaimer, the term of this patent is extended or adjusted under 35 U.S.C. 154(b) by 0 days.

(21) Appl. No.: 09/562,698

(22) Filed: Apr. 28, 2000

(30) Foreign Application Priority Data

Feb. 4, 2000 (EP) ..... 00102360

(51) Int. Cl.[7] ..... C23C 8/30
(52) U.S. Cl. ..... 148/218; 148/216
(58) Field of Search ..... 148/216, 218

(56) References Cited

U.S. PATENT DOCUMENTS

| | | | | |
|---|---|---|---|---|
| 4,531,984 A | * | 7/1985 | Madsac et al. | 148/16.6 |
| 4,547,228 A | * | 10/1985 | Girrell et al. | 148/16 |
| 4,596,611 A | * | 6/1986 | Dawes et al. | 148/16.5 |
| 5,022,934 A | * | 6/1991 | Schwing et al. | 148/16.5 |
| 5,846,341 A | * | 12/1998 | Shemetov et al. | 148/216 |

FOREIGN PATENT DOCUMENTS

| | | |
|---|---|---|
| DE | 4033706 A1 | 2/1991 |
| DE | 3937699 A1 | 5/1991 |
| DE | 4127063 A1 | 2/1992 |
| DE | 19509614 A1 | 9/1996 |
| DE | 19719225 C1 | 8/1998 |

* cited by examiner

*Primary Examiner*—Roy King
*Assistant Examiner*—Harry D. Wilkins, III
(74) *Attorney, Agent, or Firm*—R.W. Becker & Associates; R. W. Becker

(57) ABSTRACT

A method is provided for the thermal treatment of metal workpieces in a gas atmosphere containing nitrogen, in particular for nitrocarburizing iron articles. In order to obtain enhanced resistance to wear and corrosion in the treated workpieces, the nitrogen and carbon content present in the connecting layer of the case of the treated workpieces are intentionally adjusted by appropriately selecting the nitride coefficient $K_N$ and the carburizing coefficient $K_C$ of a reaction gas that contains ammonia, whereby hydrocarbons are added to the reaction gas for producing a relatively high carbon content in the connecting layer.

11 Claims, 1 Drawing Sheet

METHOD FOR THE THERMAL TREATMENT OF METAL

BACKGROUND OF THE INVENTION

The present invention relates to a method for thermal treatment of metal workpieces in a gas atmosphere containing nitrogen, in particular for nitrocarburizing iron articles. The invention furthermore relates to the use of an apparatus for performing such a method.

Metal workpieces are subjected to a thermochemical heat treatment for producing defined workpiece properties, e.g. high resistance to wear or sufficient corrosion resistance. In nitriding and nitrocarburizing, the result of the heat treatment is that the case of the workpiece is enriched with nitrogen and/or carbon in order to provide the workpiece with the required mechanical and chemical properties at the surface and in the case.

In nitriding, e.g. in a gas atmosphere containing ammonia, the surface layer or case is enriched with nitrogen in that the ammonia ($NH_3$) contained in a reaction gas generally breaks down into nitrogen (N) and hydrogen (H) at temperatures greater than 500° C. under the catalytic effects of the surface of the workpieces that are to be subjected to nitriding. The ammonia molecule is adsorbed and gradually broken down at the workpiece surface, whereby the required nitrogen is released in its atomic form and is available for dissolving in the iron and for forming iron nitride ($Fe_xRN$). In nitrocarburizing, in addition, the case is simultaneously enriched with carbon. Atomic carbon (C) diffuses through the surface of the workpiece into the case in an analogous manner.

The outermost region of the case, the so-called connecting or white layer, is of particular importance in terms of the properties that the treated workpiece must have. It is generally between 1 $\mu$m and 30 $\mu$m in thickness, and in nitriding or nitrocarburizing it comprises primarily hexagonal $\epsilon$-nitride, ($Fe_{2-3}N$) and cubic face-centered $\gamma'$-nitride ($Fe_4N$). Among processing parameters, the temperature and treatment duration selected impact the properties of the connecting layer, but the composition of the reaction gas used has the greatest impact. This is because the amount of the elements diffusing through the surface into the case (nitrogen (N), carbon (C), and even oxygen (O) and sulfur (S)) is determined by the composition of the reaction gas at given temperatures and treatment durations.

The nitride coefficient for the reaction gas $K_N=p_{NH3}/p_{H2}^{3/2}$, determined from the quotient of the partial pressure of ammonia ($p_{NH3}$) and the 1.5× potency of the partial pressure of hydrogen ($p_{H2}^{3/2}$), and the carburizing coefficient for the reaction gas $K_c=p_{CO}^2/p_{CO2}$, determined, e.g. from the quotient of the square of the partial pressure of carbon monoxide ($p_{CO}^2$) and the partial pressure of carbon dioxide ($p_{CO2}$) or alternatively determined from the quotient for the partial pressure of methane ($p_{CH4}$) and the square of the partial pressure of hydrogen ($p_{H2}^2$), are key to the content of nitrogen and carbon in the connecting layer, which connecting layer is produced primarily depending on the process parameters of temperature and treatment duration and furthermore depending on the composition of the reaction gas. Thus, given a reaction gas for nitrocarburizing, the content of which has been optimized in terms of $\epsilon$-nitride, as is conventionally done, and the composition of which is 50 vol. % ammonia ($NH_3$) and 50 vol. % endothermic gas, the carburizing coefficient $K_C$ is between 1.5 and 2.5 when the amount of ammonia in the gas atmosphere that is converted during nitrocarburizing is between 15 vol. % and 40 vol. %.

In contrast, the carburizing coefficient $K_C$ in a reaction gas with a composition of 50 vol. % $NH_3$, 45 vol. % $N_2$, and 5 vol. % $CO_2$ is substantially lower.

If nitrocarburizing is performed with an amount of carbon dioxide in the gas atmosphere that is between 0 vol. % and 7 vol. % and an amount of ammonia that is between 0 vol. % and 40 vol. %, the value for the carburizing coefficient $K_C$ increases between 0 and 0.5. The nitride coefficient $K_N$ and the carburizing coefficient $K_C$ are mutually dependant due to the balance of the components carbon monoxide (CO), water vapor $(H_2O)_V$, carbon dioxide ($CO_2$), and hydrogen ($H_2$) in the gas atmosphere, as described by the formula:

$$CO + H_2O \leftrightarrows CO_2 + H_2$$

The result of this is that the carburizing coefficient $K_C$, at a predetermined nitride coefficient $K_N$, cannot be changed except in a limited measure and thus is of limited utility for influencing workpiece properties. It is furthermore disadvantageous that the carburizing coefficient $K_C$ is not high enough in the conventionally used reaction gases so that technical properties of metal workpieces that are influenced by the content of carbon in the connecting layer, e.g. resistance to wear or resistance to corrosion, cannot be fully exploited.

It is therefore an object of the present invention to further develop a method for the thermal treatment of metal workpieces such that it is possible to obtain enhanced resistance to wear and corrosion in the treated workpieces.

BRIEF DESCRIPTION OF THE DRAWING

This object, and other objects and advantages of the present invention, will appear more clearly from the following specification in conjunction with the accompanying drawing, in which.

SUMMARY OF THE INVENTION

Figure 1:
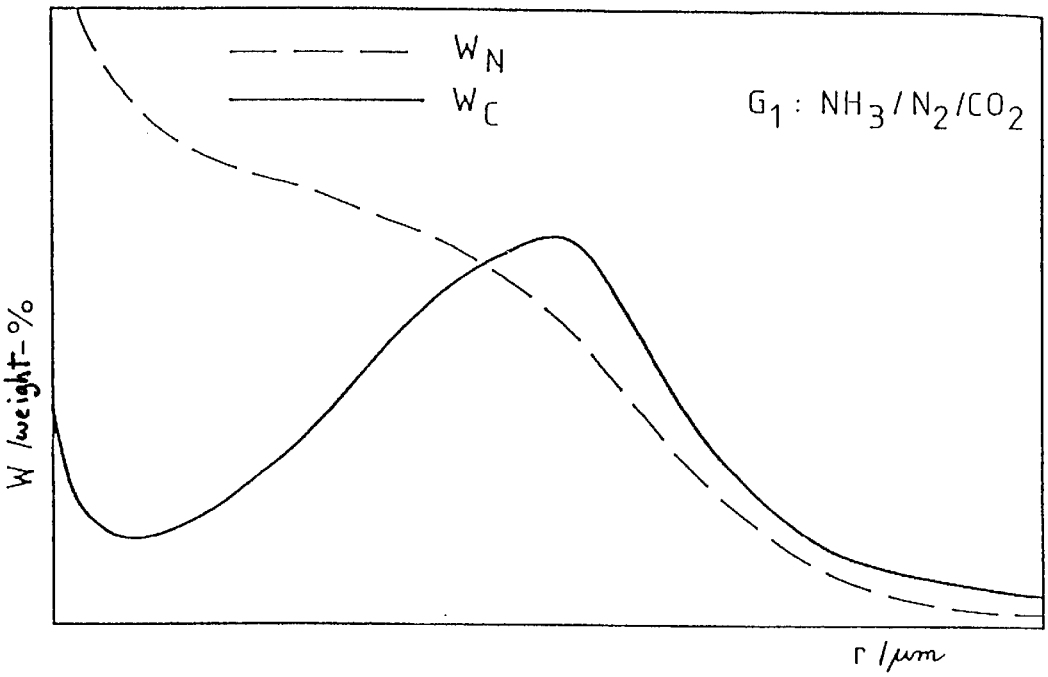
FIG. 1 is a graph illustrating the content of nitrogen and carbon in the connecting layer of a nitrocarburized workpiece as a function of distance from the case, using a conventional reaction gas; and, FIG. 2 is a diagram corresponding to FIG. 1 using a reaction gas to which a hydrocarbon is added.

The method of the present invention is characterized primarily in that the nitrogen and carbon content available in the connecting layer of the case of the treated workpieces can be intentionally adjusted by appropriately selecting the nitride coefficient $K_N$ and carburizing coefficient $K_C$ of a reaction gas containing ammonia, whereby hydrocarbons are added to the reaction gas for producing a relatively high carbon content in the connecting layer.

The surprising result of such a method is that the link between the carburizing coefficient $K_C$ and the nitride coefficient $K_N$, previously caused by the method, is eliminated by the additional carbon in the gas atmosphere resulting from the addition of hydrocarbons to the reaction gas. The addition of hydrocarbons as carbon donors makes it possible for the carburizing coefficient $K_C$ to change regardless of the nitride coefficient $K_N$. The result of this is that relatively high values can be achieved for the carburizing coefficient $K_C$ in the gas atmosphere. Since the carbon content and nitrogen content in the connecting layer in accordance with the method can be intentionally adjusted by prescribing the carburizing coefficient $K_C$ and the nitride coefficient $K_N$, a relatively higher carbon content in the connecting layer is assured and this significantly enhances resistance to wear and corrosion.

It has proved particularly advantageous to add unsaturated hydrocarbons of the formula $C_nH_{2n}$, preferably ethylene ($C_2H_4$) or propylene ($C_2H_8$). However, it is also advantageous to add saturated hydrocarbons of the formula $C_nH_{2n+2}$, preferably ethane ($C_2H_6$) or propane ($C_3H_8$), because unsaturated hydrocarbons can occur by means of thermal cleaving of the saturated hydrocarbons as the method progresses.

In order to provide a determined carburizing coefficient $K_C$ in the gas atmosphere, it is useful to add the hydrocarbons during the entire heat treatment. In an alternative further embodiment of the invention, the hydrocarbons can also be added advantageously only while a certain temperature is maintained, preferably a nitriding temperature between 500° C. and 700° C. In terms of optimizing the method relative to required workpiece properties, it can also be useful not to add the hydrocarbons until the end of the period during which the nitriding temperature is maintained.

Furthermore, the method is particularly advantageous when the hydrocarbons are not added continuously, but rather for instance only a certain intervals, this making it possible to customize the method. In accordance with an additional advantageous further development of the invention, hydrocarbons are added in amounts of 3 vol. % to 25 vol. % depending on the composition of the reaction gas. Limiting the addition of hydrocarbons as a function of the composition of the reaction gas offers the advantage that it avoids increased precipitation of free carbon, which in general leads to undesirable sootiness, e.g. in the interior of the heat treatment furnace. In an advantageous embodiment of the invention, a reaction gas is suggested that has a composition of 95 vol. % ammonia ($NH_3$) and 5 vol. % propane ($C_3H_8$); this reaction gas is also advantageous in that it is economic to produce.

Further features of the present invention will be described in detail subsequently.

DESCRIPTION OF THE PREFERRED EMBODIMENTS

Figure 2:
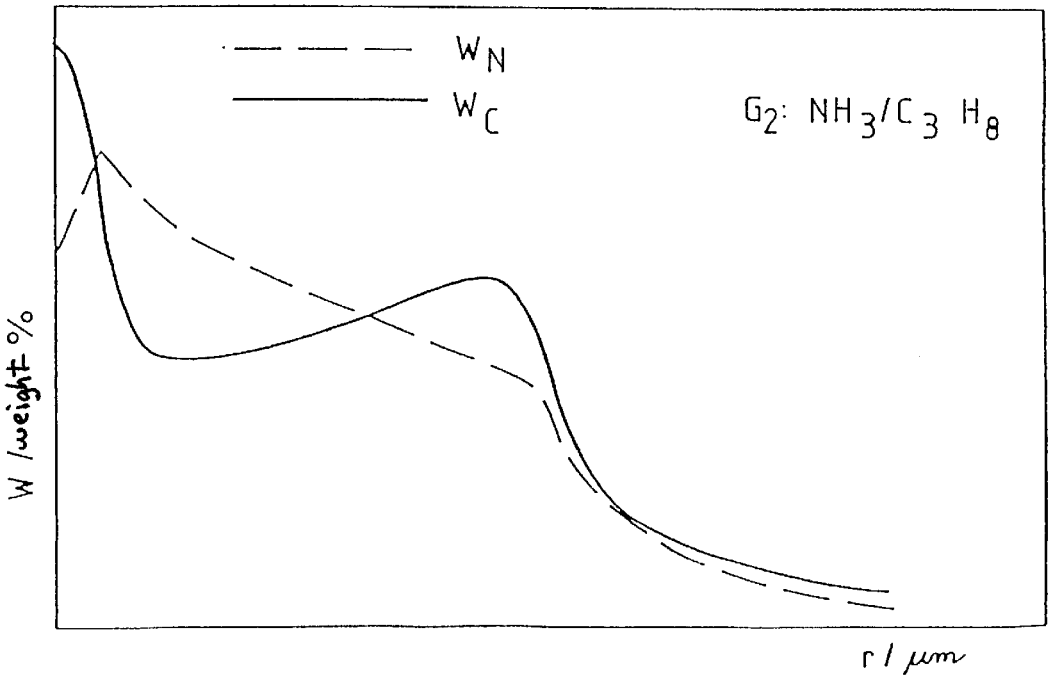

Referring now to the drawing in detail, in FIGS. 1 and 2 the content of carbon $W_C$ and nitrogen $W_N$ in the connecting layer of two nitrocarburized sample workpieces is shown as a function of the case distance r of the connecting layer. For comparative analysis of the chemical composition of the connecting layer, identical sample workpieces of 16 Mn Cr 5 steel (material 1.7131) were heated to a temperature of approx. 580° C. in a batch furnace in a gas atmosphere containing ammonia. While the first sample workpiece was treated with a conventional reaction gas $G_1$, comprising 50 vol. % $NH_3$, 45 vol. % $N_2$, and 5 vol. % $CO_2$, at a relatively high nitride coefficient of $K_N$=3.1 and an associated carburizing coefficient of $K_C$=0.2 (relative to the $CO/CO_2$ ratio), the second sample workpiece was nitrocarburized by a reaction gas $G_2$ having added hydrocarbons and with the composition 95 vol. % $NH_3$ and 5 vol. % $C_3H_8$ with about the same nitride coefficient of $K_N$=3.3 but with a higher carburizing coefficient of $K_c$=0.45 (relative to the $CH_4/H_2$ ratio). The volume flow of the reaction gases $G_1$, $G_2$ through the furnace was 4 $m^3/h$ for each. After approx. 180 minutes of nitrocarburizing, the samples were cooled to room temperature in a nitrogen atmosphere. The connecting layer measured thereafter was approx. 16 $\mu$m–18 $\mu$m for each.

Comparison of the element depth profiles shown in FIGS. 1 and 2 illustrates that in both cases the nitrogen content decreases gradually and nearly identically with depth. The nitrogen content of the sample workpiece treated with the reaction gas $G_1$ was somewhat higher only in the region near the surface.

In contrast, the depth profiles of carbon are quite different. The curve for the carbon content in the sample workpiece treated with reaction gas $G_2$ is substantially greater than that for the reaction gas $G_1$ until just past the center of the connecting layer, at which point its course is approximately parallel thereto as the nitrogen content drops. The course of the carbon content in FIGS. 1 and 2 thus confirms that the addition of propane to reaction gas $G_2$ produces a higher carbon content in the connecting layer that derives from a higher carbon coefficient $K_c$ of the reaction gas $G_2$ and that ultimately leads to enhanced resistance to wear and corrosion in the sample workpiece.

The specification incorporates by reference the disclosure of European Patent application priority document EP 00 10 2360.5 of Feb. 4, 2000.

The present invention is, of course, in no way restricted to the specific disclosure of the specification and drawings, but also encompasses any modifications within the scope of the appended claims.

What we claim is:

1. A method for thermally treating metal workpieces in a gas atmosphere that contains nitrogen, including the steps of:

intentionally adjusting a nitrogen and carbon content present in a connecting layer of a case of a workpiece by independently selecting the nitride coefficient and the carburizing coefficient of a reaction gas that contains ammonia; and adding at least one hydrocarbon to said reaction gas to eliminate dependency between the nitride coefficient and the carburizing coefficient of said reaction gas.

2. A method according to claim 1, wherein said at least one hydrocarbon is selected from the group consisting of unsaturated and saturated hydrocarbons.

3. A method according to claim 2, wherein said unsaturated hydrocarbons have the formula $C_2H_4$ and said saturated hydrocarbons have the formula $C_nH_{2n+2}$.

4. A method according to claim 3, wherein said at least one hydrocarbon is selected from the group consisting of ethylene, propylene, ethane, and propane.

5. A method according to claim 1, wherein said at least one hydrocarbon is added during the entire thermal treatment.

6. A method according to claim 1, wherein said at least one hydrocarbon is added only while a certain temperature is maintained.

7. A method according to claim 6, wherein said certain temperature is a nitriding temperature of between 500 and 700° C.

8. A method according to claim 6, wherein said at least one hydrocarbon is not added until the end of a period during which said temperature is maintained.

9. A method according to claim 1, wherein said at least one hydrocarbon is not added continuously.

10. A method according to claim 1, wherein said at least one hydrocarbon is added in an amount of from 3 to 25% by volume, depending upon the composition of said reaction gas.

11. A method according to claim 1, wherein said reaction gas has a composition of 95% by volume ammonia and 5% by volume propane.

* * * * *